United States Patent [19]

Svagr et al.

[11] Patent Number: 4,944,175

[45] Date of Patent: Jul. 31, 1990

[54] UNIVERSAL ROLLING MILL STAND WITH ADJUSTABLE SETS OF HORIZONTAL ROLLS AND VERTICAL ROLLS

[75] Inventors: Alexandr Svagr, Hilden; Hans Bogendörfer, Düsseldorf; Klaus Riebschläger, Hilden; Hans-Jürgen Reismann, Düsseldorf; Hubertus Wenig, Herne, all of Fed. Rep. of Germany

[73] Assignee: SMS Schloemann-Siemag Aktiengesellschaft, Dusseldorf, Fed. Rep. of Germany

[21] Appl. No.: 194,384

[22] Filed: May 16, 1988

[30] Foreign Application Priority Data

May 16, 1987 [DE] Fed. Rep. of Germany ..... 3716501

[51] Int. Cl.[5] ..... B21B 31/08; B21B 13/10

[52] U.S. Cl. ..... 72/225; 72/238; 72/239

[58] Field of Search ..... 72/225, 238, 239

[56] References Cited

U.S. PATENT DOCUMENTS 3,802,242 4/1974 Svagr ..... 72/225
3,948,072 4/1976 Aramaki ..... 72/225

OTHER PUBLICATIONS

SMS–Schloemann Siemag Corporation Publications, W2/327 of Nov., 1984, and W2/1258 of Jun. 1981.

*Primary Examiner*—W. Donald Bray
*Attorney, Agent, or Firm*—Toren, McGeady & Associates

[57] ABSTRACT

A universal rolling mill stand with adjustable sets of horizontal rolls and vertical rolls guided in window-type recesses of the roll housings. Each roll housing is formed by a pair of housing posts with cross-members connected by means of transverse supports. The bearing chocks of the set of horizontal rolls are vertically movable between the housing posts of the respective pair of housing posts and the bearing chocks of the set of vertical rolls are moved horizontally between outwardly cantilevering attachments of the pairs of housing posts. The upper cross-members connecting the pairs of housing posts can be raised and swung horizontally. A frame-type cage having plate-like wall members is connectible to lifting devices. The outer surfaces of the wall members of the cage are guided on guide surfaces of the housing posts of pairs of housing posts which face each other. The cage is vertically and horizontally movable with the mill stand and can be installed and removed from the rolling mill stand. The inner surfaces of the wall members of the cage form guide surfaces for adjustment movements of the bearing chucks of one or more of the rolls. The bearing chocks are supported by the cage and/or can be coupled to each other so that one is suspended from the other.

16 Claims, 7 Drawing Sheets

UNIVERSAL ROLLING MILL STAND WITH ADJUSTABLE SETS OF HORIZONTAL ROLLS AND VERTICAL ROLLS

BACKGROUND OF THE INVENTION

1. Field of the Invention

The present invention relates to a universal rolling mill stand with adjustable sets of horizontal rolls and vertical rolls guided in window-type recesses of the roll housings. The invention relates particularly to a universal rolling mill stand having two roll housing halves formed by a pair each of housing posts with cross-members connected by means of transverse supports. The bearing chocks of the set of horizontal rolls are vertically movable between the housing posts of the respective pair of housing posts. The bearing chocks of the set of vertical rolls are movable horizontally between outwardly cantilevering attachments of the pairs of housing posts. The upper cross-members connecting the pairs of housing posts can be raised and swung horizontally.

2. Description of the Prior Art

In known universal rolling mill stands of the above-described type (corporation publication SMS-SCHLOEMANN-SIEMAG AG W 2/317—November 1984 and W 2/1158 —June 1981), for mounting and removing the sets of rollers for the purpose of exchanging the rolls, the two cross-members connecting the housing posts are initially separated from the rolling mill stand and are raised or swung horizontally outwardly. Subsequently, the upper horizontal roll of the set of horizontal rolls is lifted by means of a crane with the bearing chocks from the rolling mill stand. Because of the guidance of the bearing chocks of the vertical rolls between the outwardly cantilevering attachments of the housing posts, the subsequent lifting of the vertical rolls of the set of vertical rolls including the bearing chocks requires a horizontal displacement at first of one and then of the other vertical roll of the chocks from the area of the attachments, so that the vertical rolls can then also be successively lifted upwardly by means of the crane from the rolling mill stands. The lower horizontal roll can then also be lifted out of the rolling mill stand with its chocks.

For the reasons outlined above, the removal of the sets of rolls and the installation of the new sets of rolls require complicated and time-consuming assembly procedures resulting in long idle times of the entire rolling mill train of which the universal rolling mill stand forms a part.

It is, therefore, the object of the present invention to make the assembly and disassembly of the sets of rolls simpler and less cumbersome and to reduce the time required for the assembly and disassembly.

SUMMARY OF THE INVENTION

In accordance with the present invention, a frame-type cage having plate-like wall members is provided. The cage is connectible to lifting devices. The outer surfaces of the wall members of the cage are guided on guide surfaces of the housing posts of the pairs of housing posts which face each other. The cage is vertically and possibly horizontally movable within the rolling mill stand and can be installed and removed from the rolling mill stand. The inner surface of the wall members of the cage form guide surfaces for adjustment movements of the bearing chocks of one or more of the rolls. The bearing chocks are supported by the cage and/or can be coupled to each other so that one is suspended from the other.

As a result of the construction according to the present invention, all sets of rolls can be together installed in and removed from the rolling mill stand with the bearing chocks by installing and removing the cage.

In accordance with a feature of the present invention, the bearing chocks not guided by guide surfaces of the cage may be guided by guide surfaces of the housing posts.

In accordance with a particularly advantageous further development of the invention, the bearing chocks of the upper roll of the set of horizontal rolls is vertically guided in the wall members of the cage. The bearing chocks of the set of vertical rolls are coupled to the wall members and the chocks of the lower horizontal roll are coupled to the bearing chocks of the set of vertical rolls so that one is suspended from the other. The bearing chocks of the set of vertical rolls are horizontally guided on the guide surfaces of the housing post and the lower horizontal roll is vertically guided on the guide surfaces of the housing posts.

In accordance with another feature, the guide surfaces of the housing posts guiding the wall members of the cage and the bearing chocks of the set of vertical rolls are located in a plane and continue over inwardly directed steps in guide surfaces more closely spaced apart from each other for the bearing chocks of the lower horizontal roll. These steps form slideways for the horizontal movement of the chocks of the vertical rolls. The cage can be placed with outwardly cantilevering attachments onto support surfaces of the roll housing half and can be locked to the roll housing half by means of adjustment bolts which can be inserted in fixing bores.

In accordance with an advantageous embodiment, the bearing chocks of the upper and possibly of the lower roll of the set of horizontal rolls are vertically guided and supported in the wall members of the cage and the bearing chocks of the set of vertical rolls are horizontally guided and supported in the cage. As a result, not only all sets of rolls are indirectly guided on the guide surfaces of the housing posts during the assembly and disassembly, but, when the necessary structural provisions are made, the cage with the sets of rolls can also be installed and removed laterally.

The present invention also provides that lifting devices whose travel is adjustable and fixable are arranged. These fixing devices can be coupled to the cage at the housing posts of both roll housing halves. As a result, the rolls of the set of vertical rolls can also be vertically changeably positioned, so that, for example, after a change of the set of rolls for adjusting the rolls to a pitch line, it is not necessary to vertically adjust the entire universal rolling mill stand. In addition, for achieving a greater accuracy of the web center, positional adjustments of the vertical rolls can be carried out between the individual roll passes, so that the material to be rolled enters the roll gap in as horizontal a position as possible. This results in the additional advantage that so-called tilting roll tables previously arranged in front of and behind the universal rolling mill stands are no longer necessary.

In accordance with another feature of the present invention, the universal rolling mill stands may also be constructed such that the bearing chocks of only the upper rolls of the set of horizontal rolls are vertically guided in the wall members of the cage and the bearing chocks of the set of vertical rolls are horizontally guided in the cage and that the bearing chocks of the lower horizontal roll are coupled to the bearing chocks of the set of vertical rolls so that one is suspended from the other. In that case, initially the cage is moved and fixed in the desired position and subsequently the rolls of the set of horizontal rolls are centered by means of the adjusting devices to the adjusted new pitch line.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE INVENTION

Figure 1:
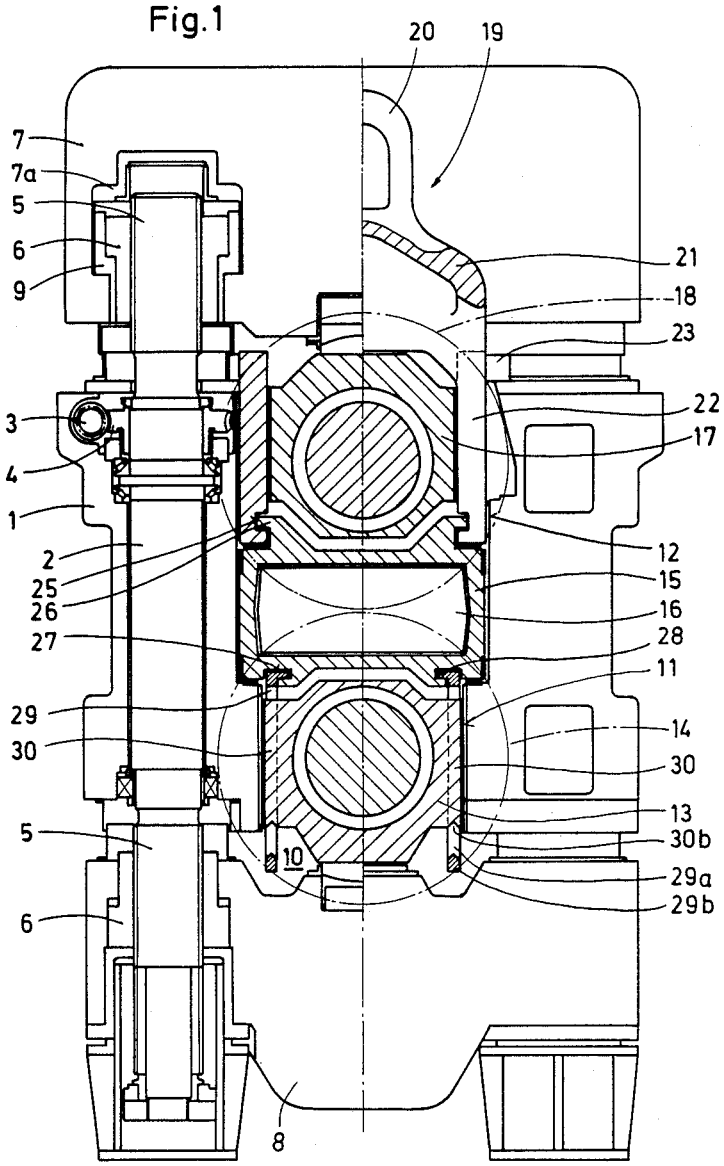
FIG. 1 is an elevational side view, partly in section, of a universal rolling mill stand.

In FIG. 1 of the drawing, a universal rolling mill stand is illustrated in sectional views taken in different planes extending perpendicularly to the axes of the horizontal rolls. Four tie rods 2 are mounted in housing posts 1 of the stand. Each tie rod 2 can be rotatively driven by means of a power-operated worm 3. Each worm 3 engages a worm gear 4 provided on the tie rod 2. Each tie rod 2 ends at both ends in threaded spindles 5 which mesh with thrust nuts 6. The thrust nuts 6 are provided in recesses of an upper and a lower transverse support 7, 8. While the lower thrust nuts 6 are mounted directly in the lower transverse support 8, the upper thrust nuts 6 are arranged in coupling sleeves 9 which are supported on the housing posts 1. The lower thrust nuts are also supported on the housing posts 1.

The upper transverse supports 17 are arranged so as to be pivotable about coupling sleeves which are not shown in the drawing. Recesses *7a* are provided in the opposite end of the upper transverse supports 7. Each recess *7a* forms a step which extends underneath the shoulder of the coupling sleeve 9. The other side of each recess *7a* has a free end. The upper transverse support 7 is pivotable by about 90°. As a result, when the upper transverse supports are pivoted, the space defined by the housing windows 10 formed by the housing posts 1 is released. The housing windows 10 have lower sides 11. The inside width of the sides 11 corresponds to the width of the bearing chocks 13 of the lower horizontal roll 15.

Figure 2:
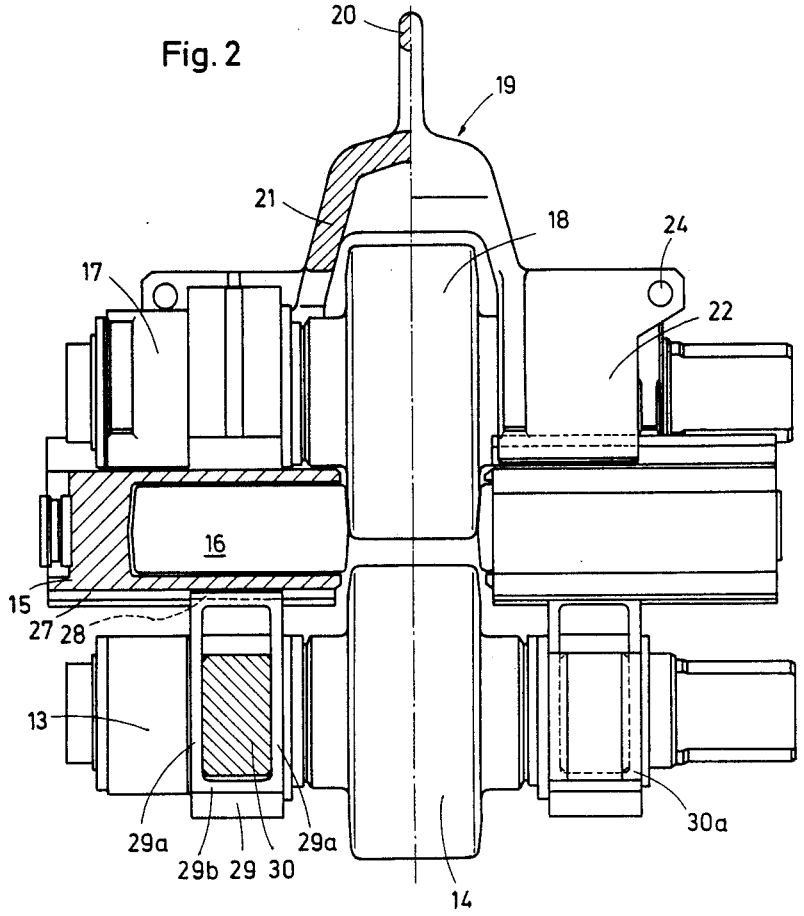
FIG. 2 is a partially sectional view in rolling direction of a cage according to the present invention with sets of horizontal rolls and vertical rolls.

The sides 12 of the housing windows 10 connected to sides 11 through steps have an increased inside width which makes possible a direct guidance of the bearing chocks 15 of the vertical rolls 16. The bearing chocks 17 of the upper horizontal roll 18 are provided thereabove. The bearing chocks 17 are vertically guided between wall members 22 which are connected together by means of a yoke 21 to a frame-type cage 19. Cage 19 can be raised and lowered by means of a lifting device with a support eye 20 which is cast onto the yoke 21 connecting the wall members 22. Yoke 21 or wall members 22 are connected to a lateral adjusting ledge 23 which serves to limit and position the mounting of the wall members 22 in the housing window 10. To ensure a secure positioning of the cage 19 in the rolling mill stand, yoke 21 and/or wall members 22 are provided with fixing bores 24, as seen in FIG. 2. Fixing bolts, not shown, guided on the housing posts 2 can be inserted in the fixing bores 24. Thus, the wall members 22 are supported, on the one hand, against sides 12 of housing window 10 and, on the other hand, they guide with its inner surfaces, preferably secured against axial displacement, the bearing chocks 17 of the upper horizontal rolls 18 in vertical direction. The downwardly facing surfaces of the wall members guide the bearing chocks 15 of the vertical rolls 16 in horizontal direction and secure the chocks 15 against vertical displacements, so that the horizontal guidance is possible with vertical guidance permitting only a narrow play without requiring special recesses in the sides of the housing windows 10. In addition, it is easily possible to remove the bearing chocks 15 upwardly without requiring a prior horizontal displacement of the bearing chocks 15 with the vertical rolls 16.

Support grooves 25 are formed in the lower portions of the inner surfaces of the wall members 22. The support groovew 25 are engaged by support keys 26 which are formed on and cantilever horizontally from the sides of the bearing chocks 15 of the vertical rolls 16. Similarly, undercut support grooves 27 are provided in the lower side of the bearing chocks 12 of the vertical rolls 16. The angular ends of support ears 29 can be placed in the support grooves 27. The support ears 29, in turn, engage attachments 30 of the bearing chocks 13 of the lower horizontal roll 14, as illustrated in FIG. 2. As can be seen in the lower right of FIG. 2, lateral bars *29a* of the ears 29 are overlapped by wearing plates *30a* of the attachments 30 of the bearing chocks 13. A web *29b* forming the lower end of the ears 29 extends underneath and spaced apart from attachments 30, so that the adjusting movement of the lower horizontal roll 14 is not impaired during operation. The lower webs *29b* of the ear 29 are shaped prismatically at the side facing the attachment 30 and engage in correspondingly-shaped grooves *30b*of the attachments 30 for lifting the rolls 14.

For carrying out a roll exchange, it is only necessary to swing the two upper transverse members 7 and 8 outwardly by 90° in order to release the upper opening between the housing posts 1. After the fixing bolts have been removed, the cage 19 can be lifted out in vertical direction from the housing posts 1 by means of a lifting device acting on support ear 29. If no special other projections are provided, the bearing chocks 17 of the upper horizontal roll 18 then rest on the bearing chocks 15 of the vertical rolls 16 and the two chocks are lifted upwardly together because the support grooves 25 of the wall members 22 engage the support keys 26 of the chocks 15 of the vertical rolls 16. As the chocks 15 are lifted, the support gears 29 engaged in chocks 15 are also lifted and, after webs 29b of the ears 29 have been placed in the grooves 30b of the attachments 30 of the chocks 13 of the upper horizontal roll 14, the lower horizontal roll 14 is also lifted. Thus, both sets of rolls, i.e., the horizontal rolls 18, 14 and the vertical rolls 16 are lifted out together in a single work step.

Figure 3:
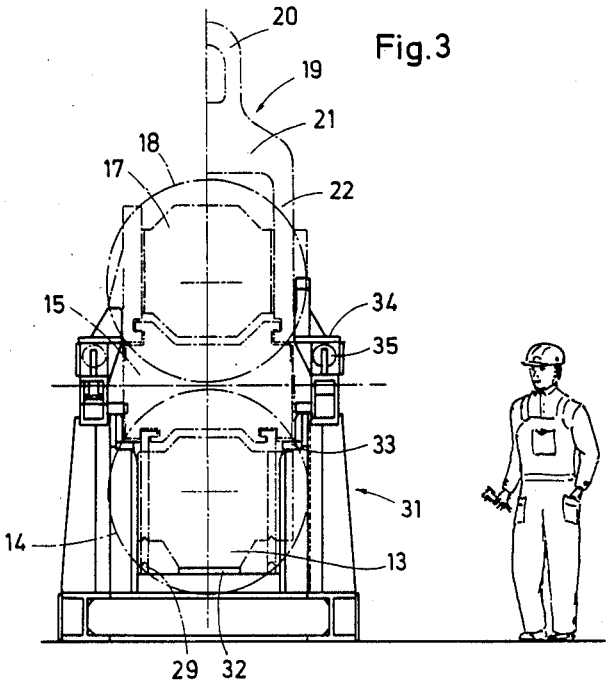
FIG. 3 is an elevational side view of the cage with the stands of horizontal rolls and vertical rolls placed on a support frame.
Figure 4:
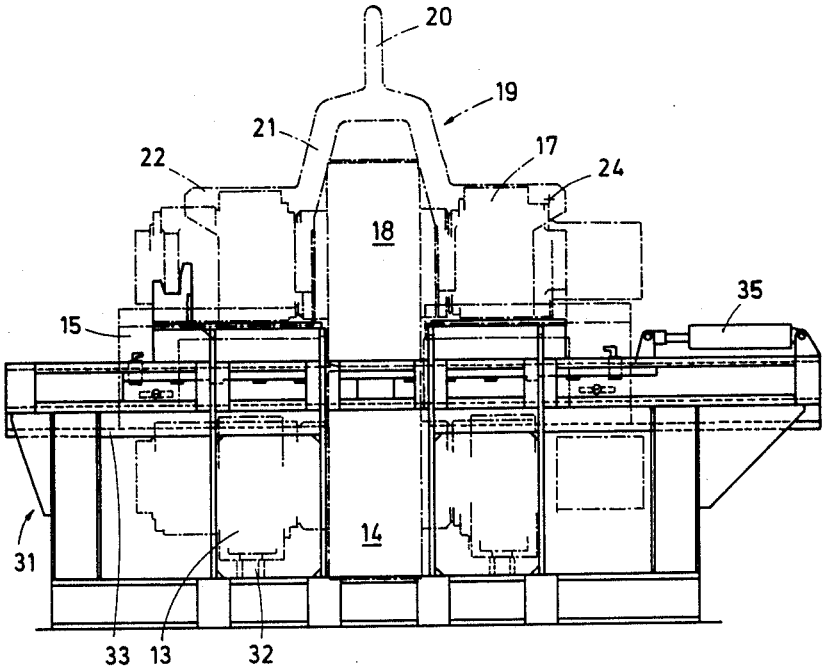
FIG. 4 is another view of the frame of FIG. 3.

For working on the sets of rollers and further disassembling the sets of rolls, a support frame 31 illustrated in FIGS. 3 and 4 is provided. Both sets of rolls can be placed on the support frame 31. The individual bearing chocks 13, 15, 17 are placed on support surfaces which may be constructed so as to be adjustable. Specifically, the bearing chocks 13 of the lower horizontal roll 14 can be placed on support plate 32, the bearing chocks 15 are received by support plates 13 arranged on both sides and the wall members 22 and/or the bearing chocks 17 of the upper horizontal roll 18 are received by support plates 34. It is also possible to provide separate support plates for the wall members 22 and the bearing chocks 17.

It has been found useful to construct the support plates, particularly the support plates for the wall members, so as to be displaceable in the direction of the axes of the horizontal rolls by means of a power drive. For this purpose, four pressure cylinder units 35 are provided. These units 35 act on the wall members which may be constructed appropriately or on common rails. It is also possible to effect oppositely directed displacements of the supports provided at different ends of the support frame 31 by means of reversible drives, particularly by means of pinions fixedly mounted between racks.

The special adjusting ledge 23 can be omitted if the thickness of the wall members 22 and the spacing of the guide plates of the housing posts 1, i.e., of the housing window 10 receiving the posts, are increased. In that case, the downwardly facing surfaces of the wall members 22 secure by means of their outer portions the vertical position of the cage 19 in the housing posts 1, while the inner portions of these surfaces limit the vertical movements of the bearing chocks 15 of the vertical roll 16.

Figure 5:
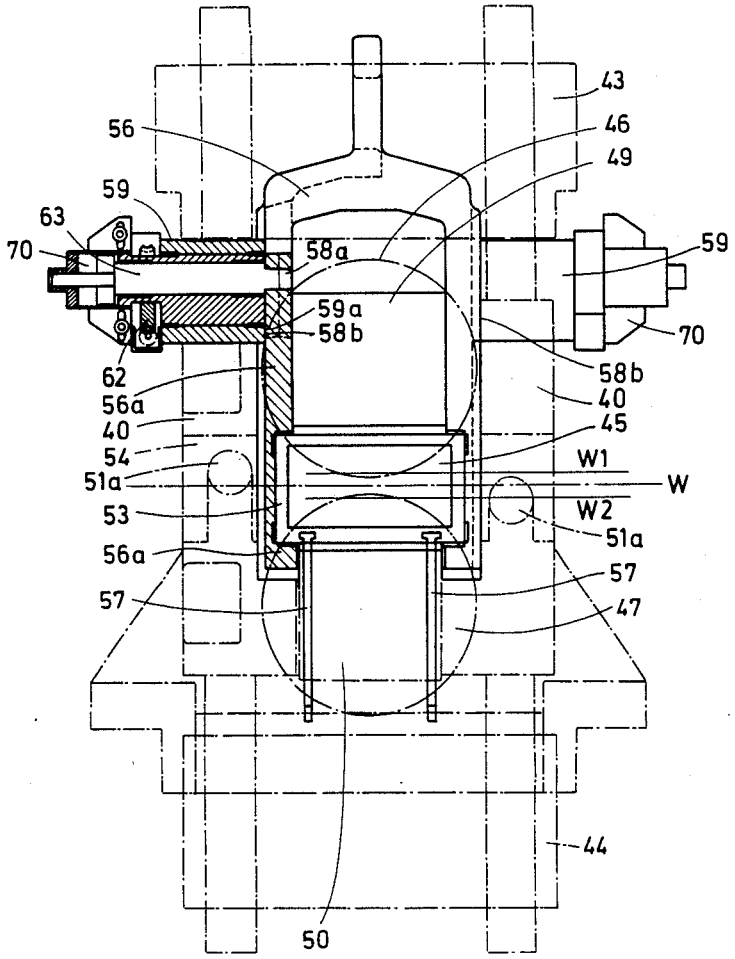
FIG. 5 is a schematic side view, partly in section, of another embodiment of a universal rolling mill stand with cage.
Figure 6:
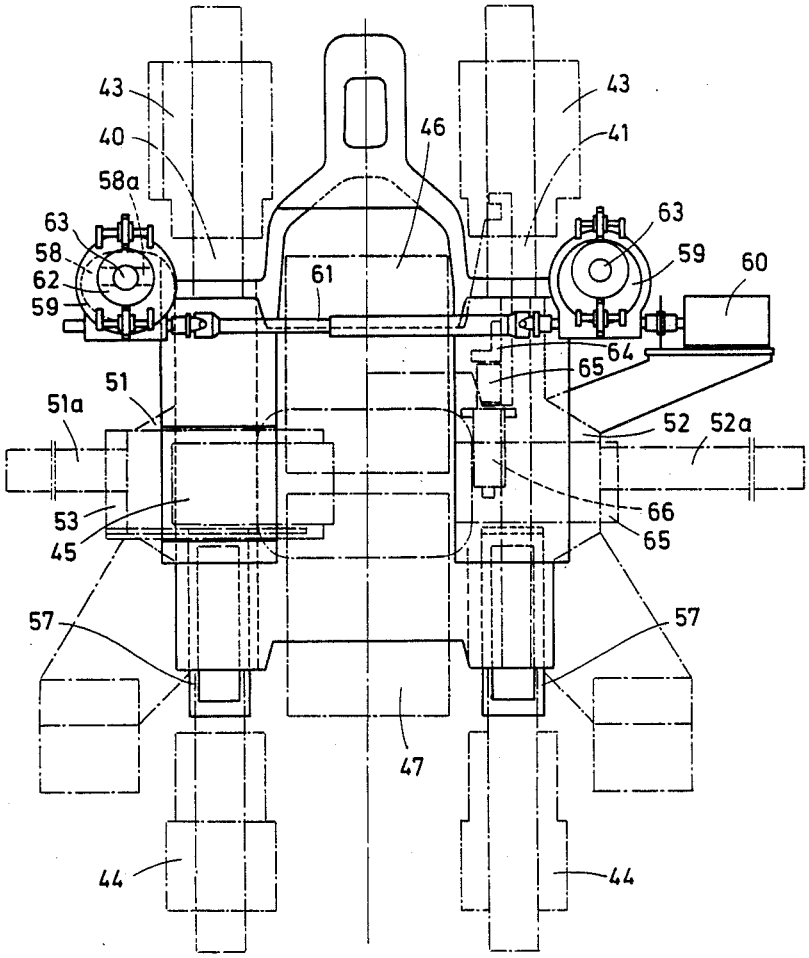
FIG. 6 is another view of the stand of FIG. 5.
Figure 7:
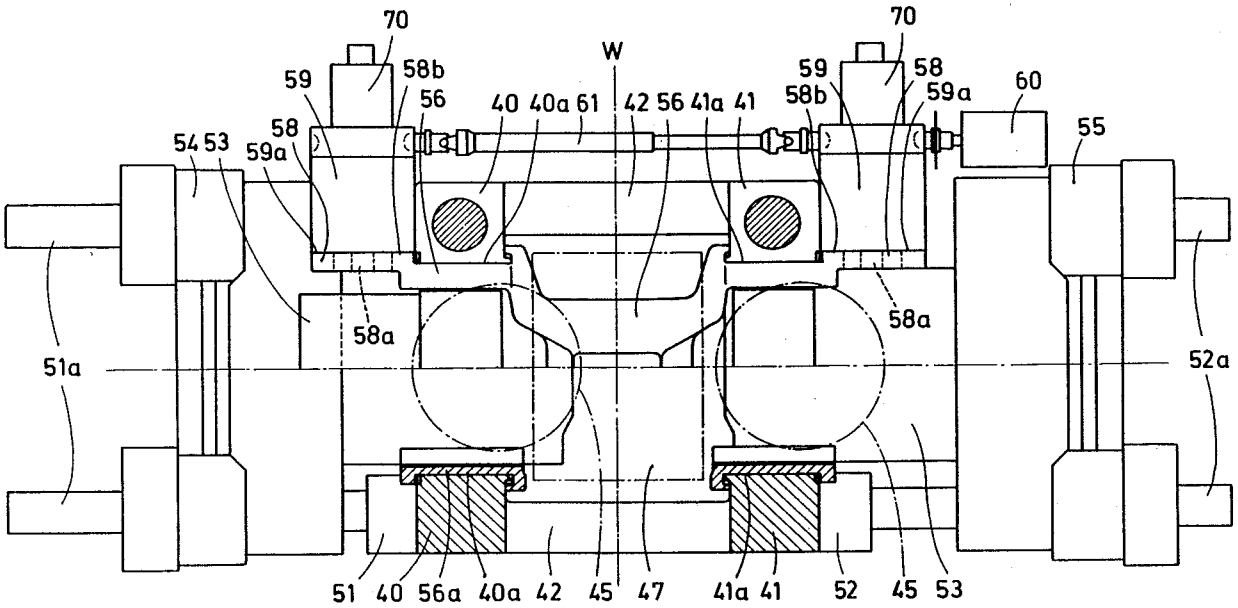
FIG. 7 is a top view of the stand of FIG. 6.

The embodiment of a universal rolling mill stand illustrated in FIGS. 5, 6 and 7 includes two roll housing halves which are connected to each other by cross-members 42. Each roll housing half has a pair of housing posts 40 and 41 which are connected or connectible by means of an upper cross-member 43 and a lower cross-member 44. The bearing chocks 49 and 50 of the two horizontal rolls 46 and 47 can be moved upwardly and downwardly between the housing posts 40 and 41, as seen in FIG. 5. As illustrated in FIGS. 6 and 7, outwardly cantilevering attachments 51 and 52 which end in threaded spindles 51a and 52a are provided on the two pairs of housing posts 40 and 41. The bearing chocks 53 of the vertical rolls 45 are horizontally moved between the attachments 51 and 52. In the illustrated embodiment, the pairs of threaded spindles 51a, 52a, are connected by means of horizontal cross-members 54 and 55 which are guided on the thread of the spindles.

The plate-like wall members 56a of the cage 56 are guided with the outer surfaces thereof between the guide surfaces 40a and 41a of the pairs of housing posts 40 and 41 of the housing halves which guide surfaces 40a and 41a face each other. The inner surfaces of the wall members 56a are guide surfaces for the vertical adjustment movement of the bearing chocks 49 of the upper horizontal roll 46 as well as for the horizontal adjustment movement of the bearing chocks 53 of the vertical rolls 45. The adjustment movements themselves are effected, in a manner which does not form part of the present invention, by an appropriate upward and downward movement of the cross-member 43 for the upper horizontal roll 46 and by a horizontal movement of the horizontal cross-members 54 and 55 for the adjustment movements of the vertical rolls 45.

As shown in FIG. 5, the bearing chocks 53 of the vertical rolls 45 are supported in the manner of a drawer in the plate-like wall members 56a of cage 56. In a manner similar to the above-described embodiment shown in FIGS. 1 to 4, the bearing chocks 50 of the lower horizontal roll 47 are connected with the bearing chocks 53 of the vertical rolls 45 by support ears 57 which can be connected to the bearing chocks 53. A vertical adjustment movement of the lower horizontal roll 47 with the chocks 50 is effected by means of the lower cross-members in a manner which is also not part of the present invention.

As illustrated in FIGS. 6 and 7, the plate-like wall members 56a of cage 56 have additional attachments 58 with The contact surfaces 58b rest on also vertically extending plane guide surfaces 59a of lifting devices 59 which are arranged in pairs on adjacent housing posts 40, 41 of the housing halves. The lifting devices 59 are driven by motors 60 and are operatively connected to each other through coupling spindles 61. Each lifting device 59 has a drive bolt 63 which is axially displaceable in an eccentric lifting gear 62, as shown in FIG. 5. The bolt 63 can be inserted and removed from the passage opening 58 of the plate-like wall members 56a of cage 56.

The piston-cylinder unit 56 in dash-dot lines and arranged on housing posts 40, 41 serve to balance the cross-members 43 during the adjustment movements thereof.

As can be seen particularly in FIG. 5 and as already explained in connection with the embodiment of FIGS. 1 to 4, the cage 56 can be lifted out of the stand or lowered into the stand by sliding along the guide surfaces 40a, 41a of the housing posts 40, 41 for the purpose of assembling or disassembling the sets of walls. The bearing chocks 49 of the upper horizontal rolls 46 rest on the bearing chocks 53 of the vertical rolls 45 and the latter are guided in the manner of a drawer and are supported from below in the cage 56. The bearing chocks 50 of the lower horizontal rolls 47 which, as in the embodiment shown in FIGS. 1 to 4, are guided directly between the guide surfaces 40a, 41a of the housing posts 40, 41, are lifted out of the stand while hanging in the ears 47 which are connected to the bearing chocks 53 of the vertical rolls 45. Referring to FIG. 5, for changing the location of the pitch line into a vertically higher position W1 or into a vertically lower position W2, the drive bolts 63 are inserted by means of a piston-cylinder unit 70 arranged on the eccentric lifting gear 22 into the passage openings 58a of the contact surfaces 58b of the attachment 58 of the plate-like wall members 56a. As seen in FIG. 6, the passage openings 58a have the shape of horizontally extending longitudinal slots. By means of the eccentric lifting gear 62, the bolts 63 of all lifting devices 59 then carry out a common lifting or lowering movement which places the cage 56 and, thus, the vertical rolls 45 into a position in which the pitch line is at the desired level between W1 and W2. Subsequently, the bolts 63 which are slightly wedge-shaped for this purpose, are forced into the passage opening 58 and, thus, lock the cage 56 in the adjusted rolling position. The two horizontal rolls 46 and 47 are then centered by means of the cross-members 43 and 44 into the adjusted pitch line.

While specific embodiments of the invention have been shown and described in detail to illustrate the application of the inventive principles, it will be understood that the invention may be embodied otherwise without departing from such principles.

We claim:

1. In a universal rolling mill stand with adjustable sets of horizontal rolls and vertical rolls guided in window-type recesses of roll housings, each roll housing having two roll housing halves formed by a pair of housing posts with cross-members connected by means of transverse supports, the rolls being provided with bearing chocks, the bearing chocks of the set of horizontal rolls being vertically movable between the housing posts of the respective pair of housing posts, the bearing chocks of the set of vertical rolls being movable horizontally between outwardly cantilevering attachments of the pair of housing posts, wherein the upper cross-members connecting the pairs of housing posts can be raised and swung horizontally, the improvement comprising a frame-type cage having plate-like members, the cage comprising means for connecting the cage comprising means for connecting the cage to lifting devices, means for guiding outer surfaces of the wall members of the cage on the guide surfaces of the housing posts of pairs of housing posts which face each other, the cage comprising means for vertically and horizontally moving the cage within the rolling mill stand and for installing the cage in and removing the cage from the rolling mill stand, inner surfaces of the wall members of the cage forming guide surfaces for adjustment movements of the bearing chocks of at least one of the rolls, the bearing chocks of at least one of the rolls being mounted to the cage and the bearing chocks of the other rolls being coupled to and suspended from the bearing chock of the at least one of the rolls mounted to the cage.

2. Universal rolling mill stand according to claim 1, comprising means for vertically guiding the bearing chocks of the upper roll of the set of horizontal rolls in the wall members of the cage, the bearing chocks of the set of vertical rolls being coupled to the wall members and the chocks of the lower horizontal roll being coupled to the bearing chocks of the set of vertical rolls so that one is suspended from the other, means for horizontally guiding the bearing chocks of the set of vertical rolls on the guide surfaces of the housing post and means for vertically guiding the lower horizontal roll on the guide surfaces of the housing posts.

3. The universal rolling mill stand according to claim 2, wherein the guide surfaces of the housing posts guiding the wall members of the cage and the bearing chocks of the set of vertical rolls are located in a plane and continue over inwardly directed steps in guide surfaces more closely spaced apart from each other for the bearing chocks of the lower horizontal roll, the steps forming slideways for the horizontal movement of the chocks of the vertical rolls.

4. The universal rolling mill stand according to claim 1, wherein the roll housing halves have support surfaces and the cage has outwardly cantilevering attachments for placement on the support surfaces of the roll housing halves.

5. The universal rolling mill stand according to claim 5, comprising adjustment bolts for locking the cage to the rolling housing half, the adjustment bolts being inserted in fixing bores.

6. The universal rolling mill stand according to claim 1, comprising means for vertically guiding and supporting the bearing chocks of the upper end of the lower rolls of the set of horizontal rolls in the wall members of the cage and means for horizontally guiding and supporting the bearing chocks of the set of vertical rolls in the cage.

7. The universal rolling mill stand according to claim 1, comprising means for vertically guiding and supporting the bearing chocks of the upper roll of the set of horizontal rolls in the wall members of the cage and means for guiding and supporting the bearing chocks of the set of vertical rolls in a drawtype support in the cage, the bearing chocks of the lower horizontal roll being coupled to the chocks of the set of vertical rolls so that one is suspended from the other and guided in the guide surfaces of the pairs of housing posts.

8. The universal rolling mill stand according to claim 6 or 7, comprising fixable lifting devices arranged on the housing posts of both roll housing halves, and means for coupling the lifting device to the cage and for adjusting travel of the lifting devices.

9. The universal rolling mill stand according to claim 8, comprising pairs of lifting devices arranged on adjacent housing posts of the two roll housing halves and a common drive for driving the lifting devices.

10. The universal rolling mill stand according to claim 8, wherein each lifting device has plane, vertical guide surfaces resting against contact surfaces of the cage, the vertical guide surfaces defining a passage opening for drive elements, means for inserting the drive element in and for removing the drive element from a passage opening defined in the contact surface of the cage.

11. The universal rolling mill stand according to claim 10, wherein the drive elements are axially displaceable and blockable bolts, the bolts being supported in an eccentric lifting gear.

12. The universal rolling mill stand according to claim 1, wherein the wall members of the cage and the bearing chocks are connected to each other by means of engaging grooves and keys.

13. The universal rolling mill stand according to 1, means for placing the bearing chocks of the lower horizontal roll in support ears and means for connecting the support ears to the bearing chocks of the vertical rolls.

14. The universal rolling mill stand according to claim 13, wherein the support yield have prismatically-shaped webs, the webs engaging in grooves defined in attachments of the chocks of the upper horizontal roll.

15. The universal rolling mill stand according to claim 1, comprising a support frame placed next to the stand, the support frame having support surfaces for attachment of the cage and for the bearing chocks of the sets of rolls.

16. The universal rolling mill stand according to claim 15, wherein the support surfaces include supports, comprising a motor for displacing the supports in axial direction of the horizontal rolls.

* * * * *